United States Patent [19]

Wolfgang et al.

[11] 4,410,491

[45] Oct. 18, 1983

[54] MATERIAL FOR ELECTRICAL CONTACTS

[75] Inventors: Böhm Wolfgang, Alzenau; Roger Wolmer, Frankfurt; Willi Malikowski, Aschaffenburg, all of Fed. Rep. of Germany

[73] Assignee: Degussa Aktiengesellschaft, Frankfurt, Fed. Rep. of Germany

[21] Appl. No.: 331,065

[22] Filed: Dec. 15, 1981

[30] Foreign Application Priority Data

Jan. 23, 1981 [DE] Fed. Rep. of Germany ..... 3102067

[51] Int. Cl.[3] ..... C22C 5/06

[52] U.S. Cl. ..... 420/501; 148/431

[58] Field of Search ..... 420/501; 148/430, 431; 200/265, 266; 252/514

[56] References Cited

U.S. PATENT DOCUMENTS

| | | | |
|---|---|---|---|
| 3,933,486 | 1/1976 | Shibata | 148/431 |
| 4,050,930 | 9/1977 | Motoyoshi et al. | 200/266 X |
| 4,204,863 | 5/1980 | Schreiner | 252/514 X |
| 4,330,330 | 5/1982 | Bohm | 200/266 X |

FOREIGN PATENT DOCUMENTS

| | | | |
|---|---|---|---|
| 2428147 | 2/1975 | Fed. Rep. of Germany | 148/431 |
| 2754335 | 6/1978 | Fed. Rep. of Germany | 148/431 |
| 2933338 | 2/1981 | Fed. Rep. of Germany | 148/431 |

*Primary Examiner*—L. Dewayne Rutledge
*Assistant Examiner*—David A. Hey
*Attorney, Agent, or Firm*—Cushman, Darby & Cushman

[57] ABSTRACT

There is described a contact material based on silver-tin oxide and additional metal oxide having a high working life, slight welding strength and low switching temperatures. Besides silver and tin oxide it contains 0.05 to 4% of molybdenum oxide and/or germanium oxide.

18 Claims, No Drawings

MATERIAL FOR ELECTRICAL CONTACTS

BACKGROUND OF THE INVENTION

The invention is directed to a material for electrical contacts of silver, tin oxide and one or more additional metal oxides.

For the production of electrical contact pieces, e.g., switches, for a large number of uses previously silver-cadmium oxide has proven best. However, because of the load placed on the environment by cadmium oxide (CdO) there have been intensive efforts to replace CdO by another metal oxide. In these investigations it has been found that tin oxide ($SnO_2$) is a suitable replacement for CdO. Because of the higher thermal stability of $SnO_2$ compared to CdO there results a clearly reduced rate of consumption which leads to a longer working life in the switching device. A very substantial disadvantage of Ag/$SnO_2$-contacts, however, is that the contact resistance at the contact is too high after several thousand switchings due to the formation of a coating layer. This as a rule this leads to increased temperatures (excess temperatures) in the switching device, which can lead to the destruction of the device and therefore are inadmissible.

A further disadvantage of these Ag/$SnO_2$ materials compared to Ag/CdO materials is in the lower margin of safety against welding. The strengths which are required to break bridge welds are in part twice as high as those with Ag/CdO contacts. Consequently, there is the danger of switching disturbances in employing Ag/-$SnO_2$.

Therefore, there have been attempts by the addition of further metal oxides to Ag/$SnO_2$ to increase the margin of safety in welding, whereby for example bismuth oxide (German OS No. 27 54 335) or indium oxide (German OS 24 28 147) are used. Indeed, these additives improve the margin of safety in welding but create an increased temperature at the contact and at the switching device which impairs the working life of the device.

By addition of tungsten oxide ($WO_3$) to Ag/$SnO_2$ there can be attained the reduction of both the excess temperature and the welding strength compared to Ag/$SnO_2$ (German OS 29 33 338 and related Bohm U.S. application Ser. No. 174,827 filed Aug. 4, 1980 and now U.S. Pat. No. 4,330,330). Through this there is attained a contact material comparable with Ag/CdO which even reaches a considerably higher working life. (The entire disclosure of the Bohm U.S. application is hereby incorporated by reference and relied upon.) However, there are desirable contact materials which have still lower tendencies to weld and lower excess temperatures.

It was the task of the invention to provide a material for electrical contacts made of silver, tin oxide and one or more additional metal oxides which has a high working life, a still lower tendency to weld and still lower temperatures in the switches compared to the known contact materials.

SUMMARY OF THE INVENTION

This problem is solved according to the invention by having the material contain 0.05 to 4 weight % of molybdenum oxide ($MoO_3$) and/or germanium oxide ($GeO_2$). Preferably it contains 8 to 20 weight % tin oxide, 0.05 to 4 weight % molybdenum oxide and/or germanium oxide, the balance consisting of silver.

It was surprisingly found that molybdenum oxide, and above all germanium oxide, still further reduces the excess temperature in the switching apparatus compared to tungsten oxide and also noticeably reduces the weld strength, although neither the melting point, boiling point and sublimation point nor the $G_o$ value is near such behavior of these two oxides. Other metal oxides having thermodynamic properties similar to tungsten oxide increase the excess temperature.

As preferred amounts of additive there have been found 0.05 to 0.9 weight % molybdenum oxide and 0.05 to 1.5 weight % germanium oxide. It is also possible to replace a part of the molybdenum oxide and/or germanium oxide content by tungsten oxide without losing the improved properties. Thus, there can be employed up to 50 weight % of tungsten oxide based on the total of tungsten and molybdenum oxide and/or germanium oxide. Usually when tungsten oxide is present it is employed in an amount of 10 to 30 weight % of the total of tungsten oxide and molybdenum oxide and/or germanium oxide. The amount of tungsten oxide used to replace the molybdenum oxide and/or germanium oxide should not be enough to significantly increase the temperature after 30,000 switchings over the temperature when employing molybdenum oxide and/or germanium oxide without tungsten oxide.

The material based on Ag/$SnO_2$ with addition of molybdenum oxide and/or germanium oxide can be produced by powder metallurgy techniques either by pressing and sintering individual contact pieces or by extruding sintered billets. There is a further advantage with germanium oxide that because of the solubility of germanium in silver this addition can also be readily provided for internally oxidized material. Experimentally applied concentrations of 0.1% Ge to Ag/Sn 7.5 resulted in a homogeneous deposition of the metal oxide in the material. The formation of a coating layer did not occur. Surprisingly it was even found that germanium caused a clear acceleration of the internal oxidation and there were reached oxidation speeds as with Ag/CdO. Besides by an addition of germanium the maximum internal oxidizable base metal content increases and therewith there is improved the safety against welding.

Unless otherwise indicated all parts and percentages are by weight.

The composition can comprise, consist essentially of or consist of the stated materials.

The following examples explain the material of the invention in greater detail.

DETAILED DESCRIPTION

EXAMPLE 1

A material having 88% Ag, 11.5% $SnO_2$ and 0.5% $MoO_3$ was produced powder metallurgically and worked to contact supports by pressing, sintering and further pressing.

EXAMPLE 2

An alloy of silver with tin and germanium was worked to a 3 mm thick sheet and internally oxidized at 820° C. for 30 hours at 9 bar with oxygen, whereby there was formed a material having 88% Ag, 11.5% $SnO_2$ and 0.5% $GeO_2$.

EXAMPLE 3

A mixture of 88% Ag, 11.5% $SnO_2$, 0.3% $MoO_3$ and 0.2% $GeO_2$ was worked in known manner power metallurgically and pressed to contact supports.

EXAMPLE 4

A mixture of 88% Ag, 11.3% $SnO_2$, 0.2% $WO_3$, 0.3% $MoO_3$ and 0.2% $GeO_2$ was worked to contact supports in known manner.

The switching tests of these materials are shown in the following table whereby several known contact materials are referred to for comparison.

The entire disclosure of German priority application No. P 31 02 067.4 is hereby incorporated by reference.

TABLE

| Material | Working Life (Number of Switchings) | Weld Strength (99.5% of all values are lower) | Temperature After Over 30,000 Switchings (°C.) |
|---|---|---|---|
| Ag/CdO 88/12 powder metallurgically | about 50,000 | 120–200 | 70–80 |
| Ag/$SnO_2$ 88/12 powder metallurgically | about 140,000 | 250–350 | 110–140 |
| Ag/$SnO_2$/$WO_3$ 88/11.5/0.5 powder metallurgically | about 140,000 | 150–220 | 70–80 |
| Ag/$SnO_2$/$MoO_3$ 88/11/5/0.5 powder metallurgically | about 140,000 | 150–190 | 60–70 |
| Ag/$SnO_2$/$GeO_2$ 88/11.5/0.5 internally oxidized | about 140,000 | 150–190 | 60–70 |
| Ag/$SnO_2$/$MoO_3$/$GeO_2$ 88/11.5/0.3/0.2 powder metallurgically | about 140,000 | 150–180 | 60–70 |
| Ag/$SnO_2$/$WO_3$/$MoO_3$/$GeO_2$ 88/11.3/0.2/0.3/0.2 powder metallurgically | about 140,000 | 150–190 | 60–70 |

What is claimed is:

1. A material suitable for an electrical contact consisting essentially of 8 to 20% tin oxide, 0.05 to 4% of molybdenum oxide, germanium oxide or a mixture of molybdenum oxide and germanium oxide, or such a material wherein a portion of the molybdenum oxide, germanium oxide or mixture of molybdenum oxide and germanium oxide is replaced by tungsten oxide, the amount of tungsten oxide being insufficient to significantly increase the switching temperature after 30,000 switchings over the temperature when employing molybdenum oxide, germanium oxide or a mixture of molybdenum oxide and germanium oxide without tungsten oxide, balance silver.

2. A material according to claim 1 consisting essentially of tin oxide, molybdenum oxide, germanium oxide or a mixture of molybdenum oxide and germanium oxide and silver.

3. A material according to claim 2 consisting essentially of tin oxide, molybdenum oxide and silver.

4. A material according to claim 2 consisting essentially of tin oxide, germanium oxide and silver.

5. A material according to claim 2 consisting essentially of tin oxide, molybdenum oxide, germanium oxide and silver.

6. A material according to claim 2 containing 0.05 to 0.9% molybdenum oxide and free from germanium oxide.

7. A material according to claim 2 containing 0.05 to 1.5% of germanium oxide and free from molybdenum oxide.

8. A material according to claim 2 containing 0.05 to 0.9% molybdenum oxide and 0.05 to 1.5% germanium oxide.

9. A material according to claim 2 consisting of tin oxide, molybdenum oxide, germanium oxide or a mixture of molybdenum oxide and germanium oxide and silver.

10. A material according to claim 1 containing tungsten oxide.

11. A material according to claim 10 containing 0.05 to 0.9% molybdenum oxide and free from germanium oxide.

12. A material according to claim 10 containing 0.05 to 1.5% germanium oxide and free from molybdenum oxide.

13. A material according to claim 10 containing 0.05 to 0.9% molybdenum oxide and 0.05 to 1.5% germanium oxide.

14. A material according to claim 10 wherein the amount of tungsten oxide is not over about 0.2%.

15. A material according to claim 1 consisting of 88% Ag, 11.5% $SnO_2$ and 0.5% $MoO_3$.

16. A material according to claim 1 consisting of 88% Ag, 11.5% $SnO_2$ and 0.5% $GeO_2$.

17. A material according to claim 1 consisting of 88% Ag, 11.5% $SnO_2$, 0.3% $MoO_3$ and 0.2% $GeO_2$.

18. A material according to claim 1 consisting of 88% Ag, 11.3% $SnO_2$, 0.2% $WoO_3$, 0.3% $MoO_3$ and 0.2% $GeO_2$.

* * * * *